US010272351B2

(12) United States Patent
Strauss

(10) Patent No.: US 10,272,351 B2
(45) Date of Patent: Apr. 30, 2019

(54) TRANSFORMABLE TOY

(71) Applicant: Jay At Play International Hong Kong Limited, Kowloon (HK)

(72) Inventor: Ivy Booker Strauss, Mamroneck, NY (US)

(73) Assignee: JAY AT PLAY INTERNATIONAL HONG KONG LIMITED, Kowloon (HK)

( * ) Notice: Subject to any disclaimer, the term of this patent is extended or adjusted under 35 U.S.C. 154(b) by 8 days.

(21) Appl. No.: 15/477,908

(22) Filed: Apr. 3, 2017

(65) Prior Publication Data

US 2018/0280819 A1 Oct. 4, 2018

(51) Int. Cl.

| | |
|---|---|
| ***A63H 3/12*** | (2006.01) |
| ***A63H 33/00*** | (2006.01) |
| ***A63H 3/02*** | (2006.01) |
| ***A63H 3/36*** | (2006.01) |

(52) U.S. Cl.

CPC ..... *A63H 33/004* (2013.01); *A63H 3/02* (2013.01); *A63H 3/12* (2013.01); *A63H 3/365* (2013.01)

(58) Field of Classification Search

CPC ... A63H 3/00; A63H 3/02; A63H 3/12; A63H 3/36; A63H 3/365; A63H 33/003; A63H 33/004

See application file for complete search history.

(56) References Cited

U.S. PATENT DOCUMENTS 1,396,766 A 11/1921 McClelland
1,407,165 A * 2/1922 Pajeau ..... A63H 3/00 446/321
1,425,974 A * 8/1922 Kearney ..... A63H 3/02 446/321
1,690,778 A 11/1928 Ford
3,487,573 A * 1/1970 Slovacek ..... B42D 15/04 281/15.1
3,811,220 A * 5/1974 Glass ..... A63H 3/12 446/321
3,830,012 A * 8/1974 Franke ..... A63H 3/006 446/321
3,851,419 A 12/1974 Kaelin
3,994,091 A * 11/1976 Modell ..... A63H 33/22 446/149

(Continued)

FOREIGN PATENT DOCUMENTS

WO 2015195481 12/2015

OTHER PUBLICATIONS

Plushiemorphs—Transforming Toys Powered by Pure Imagination, known and accessible to the public at least as early as Mar. 8, 2017, retrieved from the Internet at https://plushiemorphs.com/products-2/, 5 pages and a Statement of Relevance.

*Primary Examiner* — Gene Kim

*Assistant Examiner* — Alyssa Hylinski

(74) *Attorney, Agent, or Firm* — Michael Best & Friedrich LLP

(57) ABSTRACT

A toy includes a body, a head coupled to the body and having a face surface, and a flap coupled to the head. The flap is movable relative to the face surface between a first position in which a first face is exposed to view on the face surface, and a second position in which a second face, at least partially different from the first face, is exposed to view on the face surface.

19 Claims, 12 Drawing Sheets

(56) References Cited

U.S. PATENT DOCUMENTS

| | | | | | |
|---|---|---|---|---|---|
| 4,336,665 | A | | 6/1982 | Moreau | |
| 4,614,505 | A | | 9/1986 | Schneider et al. | |
| 4,695,264 | A | | 9/1987 | McLeod, Jr. | |
| 4,734,948 | A | | 4/1988 | Danova | |
| 4,776,823 | A | | 10/1988 | Hanlon | |
| 4,921,459 | A | | 5/1990 | Cook et al. | |
| 5,090,938 | A | | 2/1992 | Reynolds | |
| 5,178,574 | A | * | 1/1993 | Evoy | A63H 3/365 446/372 |
| 5,573,439 | A | * | 11/1996 | Turner | A63H 3/06 446/220 |
| 5,649,848 | A | | 7/1997 | Clark | |
| 5,842,900 | A | | 12/1998 | Hodge | |
| 5,947,791 | A | * | 9/1999 | Taylor | A63H 3/00 446/321 |
| 6,409,572 | B1 | * | 6/2002 | Gwon | A63H 3/365 446/339 |
| 6,514,118 | B1 | | 2/2003 | Bart et al. | |
| 6,758,717 | B1 | | 7/2004 | Park et al. | |
| 6,962,517 | B2 | | 11/2005 | Murray | |
| D647,979 | S | | 11/2011 | Fromuth | |
| 8,506,344 | B2 | | 8/2013 | Chan et al. | |
| 8,672,724 | B2 | | 3/2014 | Beuerle | |
| 8,869,325 | B2 | | 10/2014 | Ng et al. | |
| 9,415,322 | B2 | | 8/2016 | Kanauchi | |
| 2008/0182478 | A1 | | 7/2008 | Smoot et al. | |
| 2014/0220851 | A1 | | 8/2014 | Bennett | |
| 2015/0314205 | A1 | | 11/2015 | Rebella et al. | |

* cited by examiner

TRANSFORMABLE TOY

BACKGROUND

The present invention relates to toys, and more particularly to toys that transform between two or more configurations.

SUMMARY

In one embodiment, the invention provides a toy having a body, a head coupled to the body and having a face surface, and a flap coupled to the head. The flap is movable relative to the face surface between a first position in which a first face is exposed to view on the face surface, and a second position in which a second face, at least partially different from the first face, is exposed to view on the face surface.

In another embodiment the invention provides a toy having a body and a head coupled to the body. The head has a first configuration in which a first indicia representing a first feature and a second indicia representing a second feature are exposed to view on a face surface of the head, and a second configuration in which the first indicia representing the first feature, a third indicia representing a third feature, and the second indicia are all exposed to view on the face surface of the head. The second indicia represents a fourth feature different from the second feature when the head is in the second configuration. A flap is coupled to the head for movement relative to the face surface between a first position, in which the head is in the first configuration, and a second position, in which the head is in the second configuration.

Other aspects of the invention will become apparent by consideration of the detailed description and accompanying drawings.

DETAILED DESCRIPTION

Figure 1:
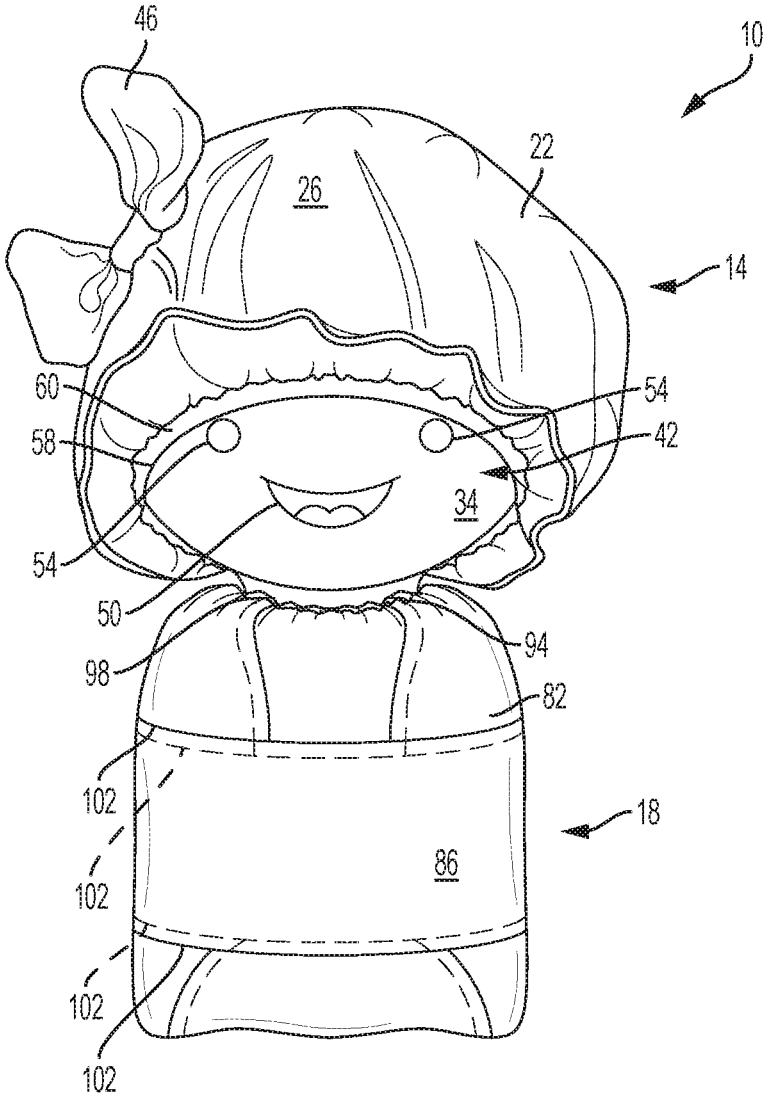
FIG. 1 is a front view of a toy embodying the invention shown in a first state representative of an infant child.

Before any embodiments of the invention are explained in detail, it is to be understood that the invention is not limited in its application to the details of construction and the arrangement of components set forth in the following description or illustrated in the following drawings. Use of relative terms such as "right,' "left," "front," "back," "lower," "upper," "over," "under," "up," "down," "top," and "bottom," as well as derivatives of such terms (e.g., "downwardly" and "upwardly") should be construed to refer to exemplary orientation as then described or as shown in the drawing under discussion. These relative terms are for convenience of description and do not require that the apparatus be constructed or operated in a particular orientation. The invention is capable of other embodiments and of being practiced or of being carried out in various ways.

FIGS. 1-6 illustrate a transformable toy 10 according to a first embodiment of the present invention. A first configuration of the toy 10 displays a first image, design, character or object, and a second configuration displays a second different image, design, character or object. The images or characters that may be displayed include, for example, commonly known movie or television characters, animated characters, animals, humans, inanimate objects, fantasy creatures or characters, historical characters, characters from books or other sources, or other articles, whether real or imagined. The materials used to form the toy 10 may be any suitable materials, including plush fabric, knit fabric, woven fabric, plastic, rubber, or any other suitable material for use as a toy.

Figure 2:
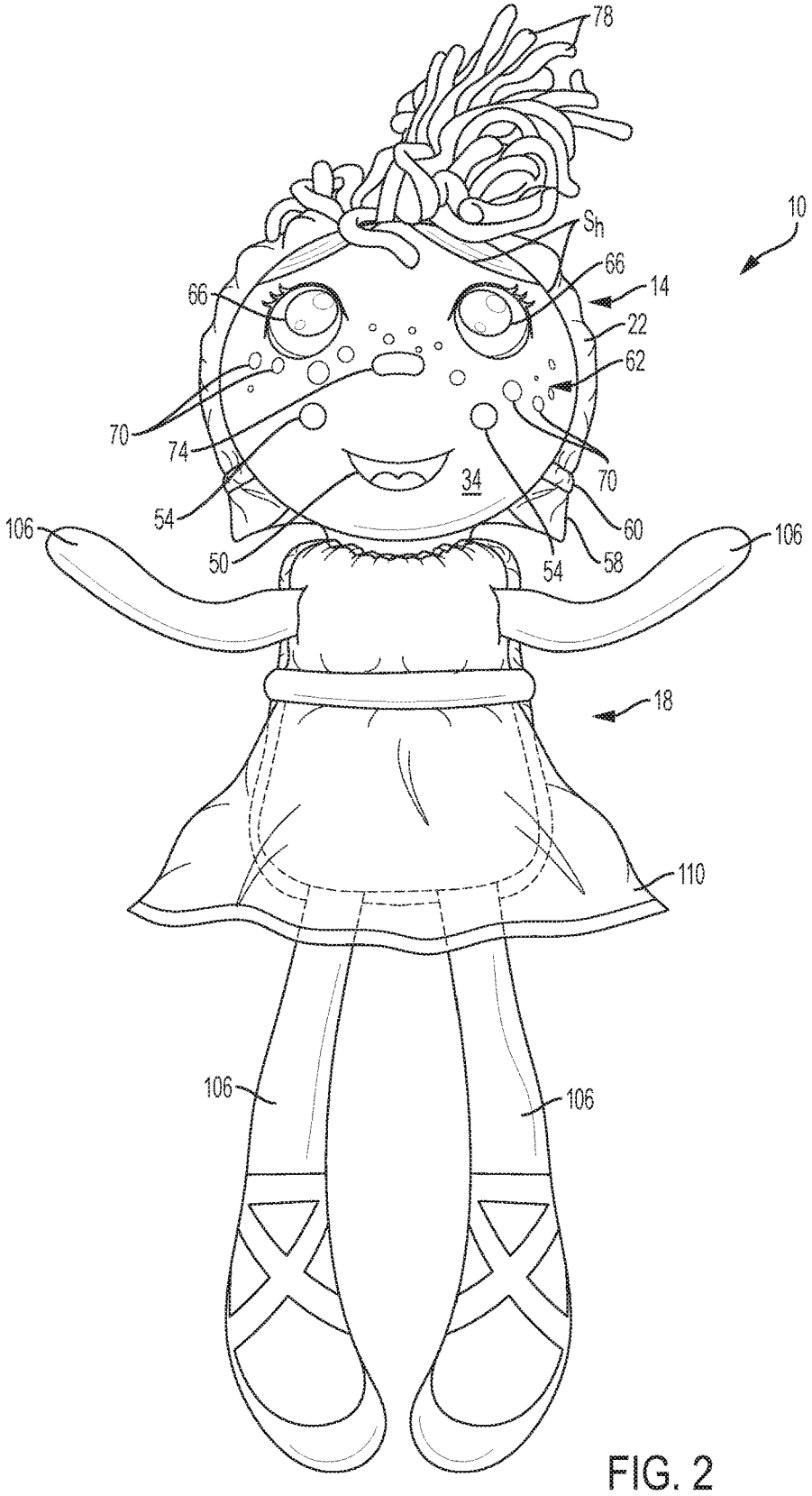
FIG. 2 is a front view of the toy of FIG. 1 shown in a second state representative of a more mature child or young adult.

FIG. 1 shows the toy 10 in a first state representative of an infant child. FIG. 2 shows the toy 10 in a second state representative of a more mature child or young adult. The toy 10 has a head 14 and a body 18 coupled to the head 14. In the illustrated embodiment, each of the head 14 and the body 18 are transformable between two different configurations. Specifically, FIG. 1 illustrates the first head configuration and the first body configuration, together representative of the infant child. FIG. 2 illustrates the second head configuration and the second body configuration, together representative of the more mature child or young adult. The head 14 and body 18 are separately transformable between the two configurations such that, for example, the body 18 can be in the first configuration while the head 14 can be in the second configuration (see FIG. 3). Likewise, and while not shown, the body 18 can be in the second configuration while the head 14 can be in the first configuration.

Figure 3:
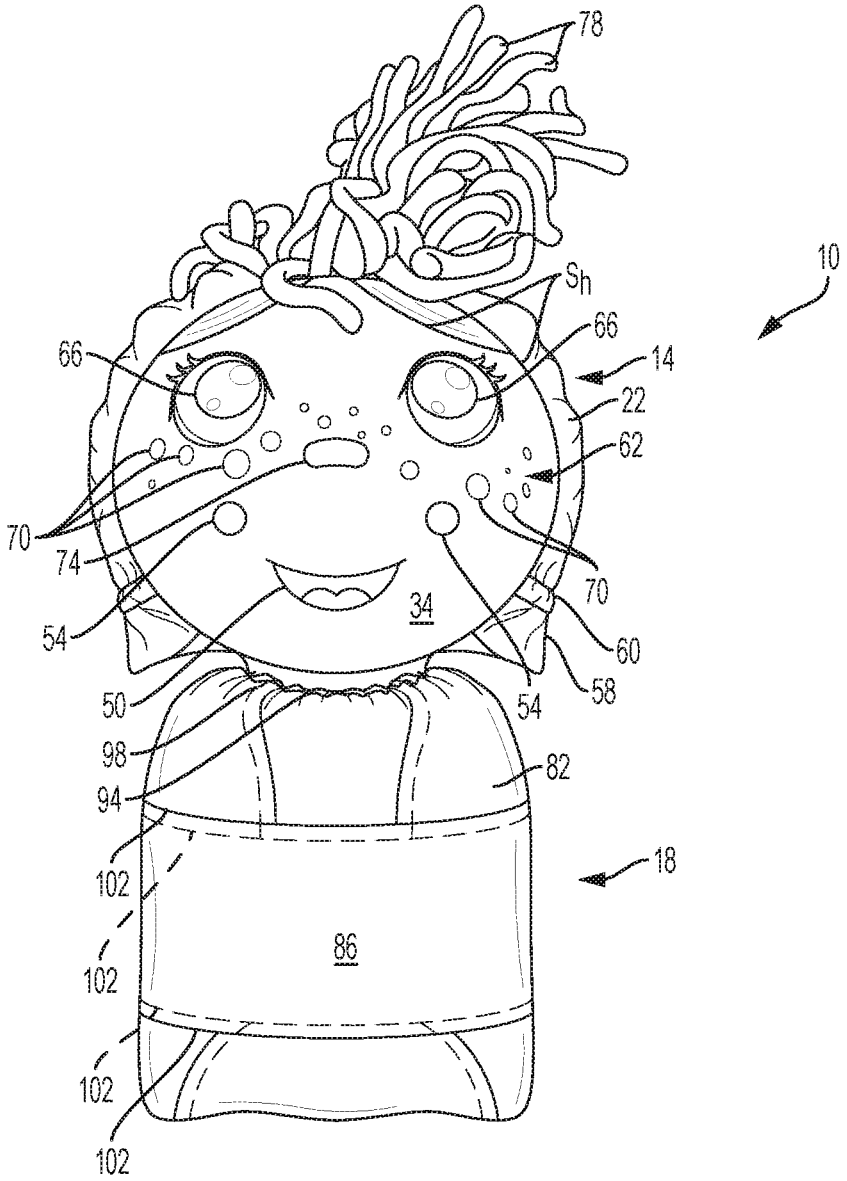
FIG. 3 is a front view of the toy of FIG. 1 showing the head transformed to a second configuration representing the more mature child or young adult.
Figure 4:
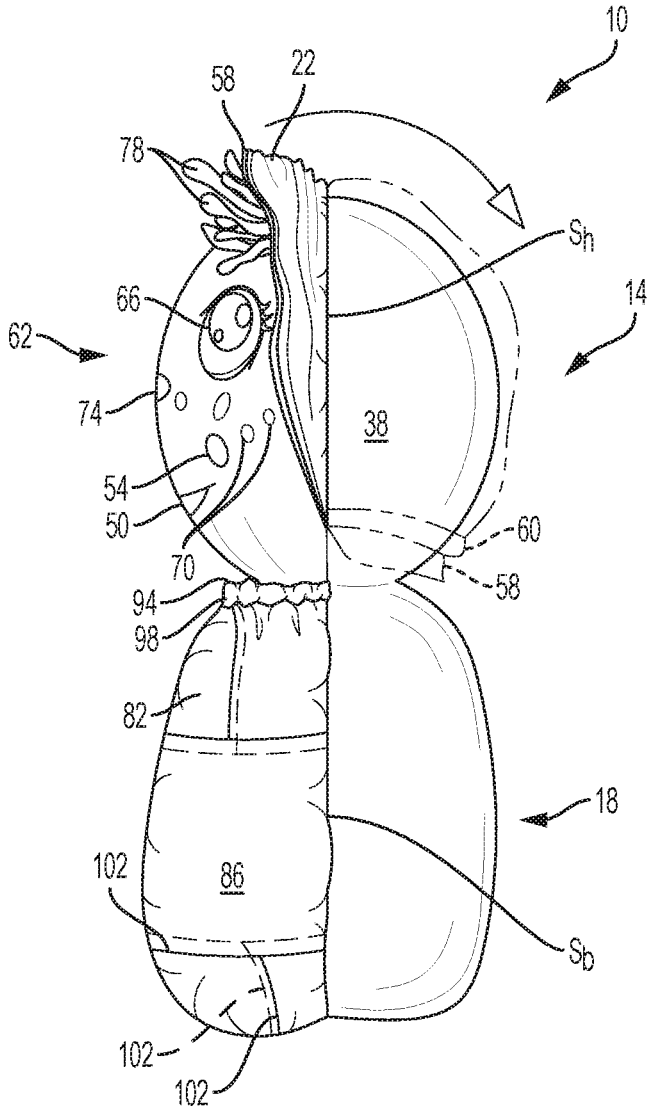
FIG. 4 is a side view showing the transformation of the head from a first head configuration to the second head configuration.

FIG. 4 illustrates the transformation of the head 14 from the first configuration to the second configuration. A first flap 22 coupled to the head 14 is moveable between at least two different positions to change which configuration of the head 14 is displayed. In the illustrated embodiment, the first flap 22 includes a first position that presents to view a first flap surface 26 (FIG. 1) and a second position that presents to view a second flap surface 30 (FIG. 6). The first and second surfaces 26, 30 of the first flap 22 are opposite surfaces of the first flap 22, and as illustrated in FIGS. 1-6, form the interior and exterior surfaces of the flap 22, depending upon the position of the first flap 22 on the head 14.

The head 14 includes a front or face surface 34 and an oppositely-facing rear surface 38 (see FIG. 4). The first flap 22 is coupled (e.g., sewn, adhered, hinged, etc.) to the head 14 about the upper perimeter of the face surface 34. In the illustrated embodiment, the first flap 22 is sewn to the head 14 along a seam $S_h$ (see FIGS. 2-4) that runs along an upper perimeter of the face surface 34. In this regard, the upper portion of the face surface 34 is bounded by the seam $S_h$.

Referring to FIG. 1, the face surface 34 includes a first face 42 that is exposed to view when the head 14 is in the first configuration and the flap 22 is in the first position. When the flap 22 is in the first position, less than the entire face surface 34 is exposed to view with the flap 22 covering the remainder of the face surface 34. In the illustrated embodiment, the first surface 26 of the flap 22 is the exterior or outer surface exposed to view and represents a hat or bonnet covering a portion of the head 14. A bow or other appendage 46 may be coupled to the first surface 26. The first face 42 includes a first indicia 50 representing a mouth of the first face 42. As used herein and in the appended claims, the term "indicia" means any marking, coloration, formation, projection, indentation, or other indicator used to represent a feature of the toy 10. The indicia can be a single feature or can represent multiple features or groups of features. In the illustrated embodiment, the first indicia 50 representing the mouth is screen-printed, painted, or otherwise indicated by coloring the face surface 34. In other embodiments, the first indicia 50 representing the mouth could be sewn, embroidered, or applied as a separate piece via a patch, sticker, or other add-on feature.

The first face 42 further includes a second indicia 54 representing the two eyes of the first face 42. In the illustrated embodiment, the second indicia 54 representing the two eyes is screen-printed, painted, or otherwise indicated by coloring the face surface 34. The second indicia 54 representing the two eyes is positioned on the face surface 34 such that when the flap 22 is in the first position, an edge 58 of the flap 22 is positioned just above the second indicia 54 such that the eyes represented by the second indicia 54 are exposed to view to form the eyes of the first face 42. The edge 58 of the flap 22 can include an elastic member 60 to secure the flap 22 in position relative to the face surface 34 when the flap 22 is in the first position so that the first face 42 is exposed to view. Therefore, in the illustrated embodiment, the first face 42 includes the first indicia 50 representing the mouth and the second indicia 54 representing the two eyes.

Referring to FIGS. 2 and 3, the face surface 34 also includes a second face 62 that is exposed to view when the head 14 is in the second configuration and the flap 22 is in the second position. When the flap 22 is in the second position, the entire face surface 34 is exposed to view, with the flap 22 being moved over the top of the head 14 such that the second flap surface 30 is presented to view on the back side of the head 14 (see FIG. 6). In this manner, the second face 62 has a larger surface area than the first face 42. The edge 58 of the flap 22 (including the elastic member 60) is adjacent a lower portion of the rear surface 38 of the head 14 in this second position. When the flap 22 is in this second position, the second face 62 again includes the first indicia 50 representing the mouth. In other words, the first indicia 50 represents the mouth on each of the first face 42 and the second face 62.

The second face 62 further includes third indicia 66 representing the eyes of the second face 62. The third indicia 66 representing the eyes of the second face 62 is distinct from the second indicia 54 that represented the eyes of the first face 42 and is positioned closer to the top of the head 14 (i.e., closer to the seam $S_h$) than the second indicia 54. In the illustrated embodiment, the third indicia 66 representing eyes is screen-printed, painted, or otherwise indicated by coloring the face surface 34, but is done so in a way to represent eyes that are bigger in size than the eyes represented by the second indicia 54. Additionally, and optionally, the third indicia 66 representing eyes includes more detail than the second indicia 54, including representation of eyes having pupils as well as eyebrows and/or eye lashes. Multiple colors can also be used with the third indicia 66. In the illustrated embodiment, however, the lateral distance between the two eyes of the second indicia 54 is approximately the same as the lateral distance between the two eyes of the third indicia 66 to maintain the general scale of the width of the first and second faces 42, 62.

The second face 62 further includes fourth indicia 70 representing freckles on the second face 62. In the illustrated embodiment, the represented freckles of the fourth indicia 70 are of different sizes and colors, and can be positioned about the second face 62 at locations above the first indicia 50 representing the mouth and below or at the same level as the third indicia 66 representing the eyes of the second face 62. The illustrated fourth indicia 70 representing freckles is screen-printed, painted, or otherwise indicated by coloring the face surface 34, and is done so in a manner that is consistent with the formation of the second indicia 54 such that the second indicia 54 and the fourth indicia 70 appear to be the same or similar on the second face 62. In other words, the second indicia 54 look like freckles on the second face 62 just like the representation of the freckles formed by the fourth indicia 70. Consistent shape, sizing, coloring, and the like are used to form the second indicia 54 and the fourth indicia 70. Alternatively, the second indicia 54 can also represent dimples on the second face 62, as they are located in position relative to the first indicia 50 that could represent either freckles or dimples on the second face 62.

The second face 62 can further include a fifth indicia 74 representing a nose on the second face 62. The illustrated fifth indicia 74 representing the nose is screen-printed, painted, or otherwise indicated by coloring the face surface 34. It should again be noted that any or all of the indicia 50, 54, 66, 70, 74 can be formed in other manners using other techniques, and are not limited to screen-printed, painted, or otherwise colored markings. For example, the fifth indicia 74 representing the nose of the second face 62 could be formed by a button or other member secured to the face surface 34. Likewise, the third indicia 66 representing the eyes of the second face 62 could be formed by attachable items representing eyes.

The toy 10 can further include one or more projecting members or appendages 78 coupled to the head 14 near the top of the head 14 to represent further features of the second configuration of the head. For example, as shown in FIG. 2, the appendages 78 can represent the hair of the more mature child or young adult form of the toy 10. In other embodiments, the appendages 78 could represent ears (see FIG. 8), horns, fins, antennae, or other features that might be present on the head of an animal or other creature. The appendages 78 can be covered and hidden from view by the flap 22 when the flap 22 is in the first position, and then exposed to view when the flap 22 is in the second position.

Transforming the toy 10 between the first head configuration and the second head configuration is achieved by moving the flap 22 between the first and second positions. When the flap 22 is in the first position of FIG. 1 to expose only the smaller portion of the face surface 34 to view, the first face 42 is defined by the first indicia 50 representing the mouth and the second indicia 54 representing the eyes. In this first position, the flap 22 appears to be the hat or bonnet and covers the third, fourth and fifth indicia 66, 70, 74 so that they cannot be seen and form no part of the first face 42. The appendages 78 are also covered and hidden from view by the flap 22. To transform the head 14 to the second configuration, in which the larger second face 62 is exposed to view, the flap 22 is moved (e.g., rotated or pivoted about the seam $S_h$) over the top of the head 14 to the second position of FIGS. 2 and 3. The edge 58 of the flap 22 can be pulled all the way down to be positioned at the lower portion of the rear surface 38 of the head 14. The larger first face 62 is now defined by the first indicia 50 representing the mouth and the third indicia 66 representing the eyes. The second indicia 54, which previously represented the eyes of the first face 42, now blends in with and appears to be similar to the fourth indicia 70 representing freckles, such that the second indicia 54 now represent additional freckles (or dimples) on the second face 62. The second indicia 54 do not appear to be eyes when viewed as an overall part of the second face 62. The second face 62 is further defined by the fifth indicia 74 representing the nose.

To transform the toy 10 back to the first head configuration, the flap 22 is simply moved from the second position back over the top of the head 14 to the first position so that each of the third, fourth, and fifth indicia 66, 70, 74 are covered by the flap 22, with only the first and second indicia 50, 54 exposed to view to represent the mouth and eyes of the infant child. The edge 58 of the flap 22 can be carefully positioned just above the second indicia 54 representing the eyes such that the elastic member 60 maintains the flap 22 in this first position. In this manner, transforming the head 14 between the two configurations is easy.

Figure 5:
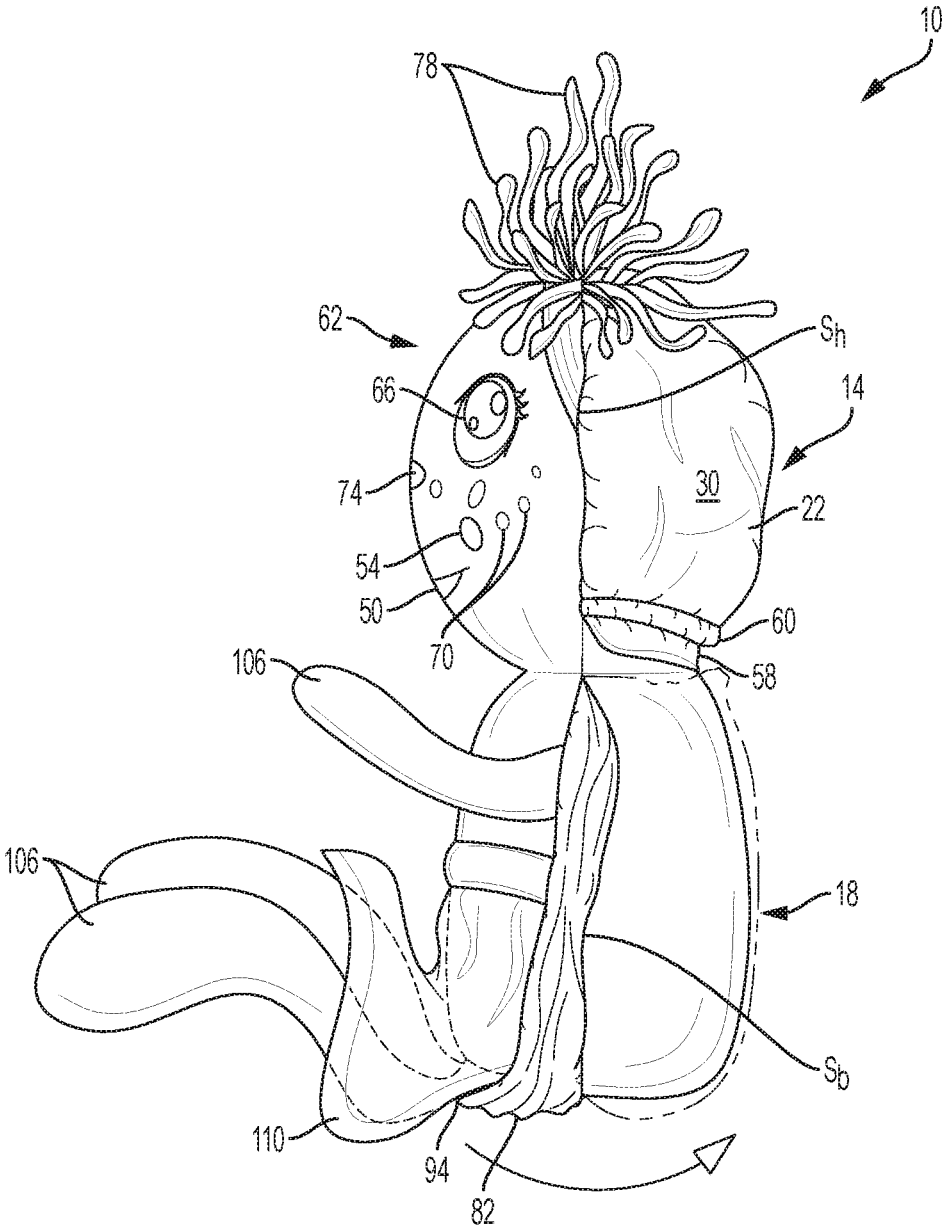
FIG. 5 is a side view showing the transformation of the body from a first body configuration to a second body configuration.
Figure 6:
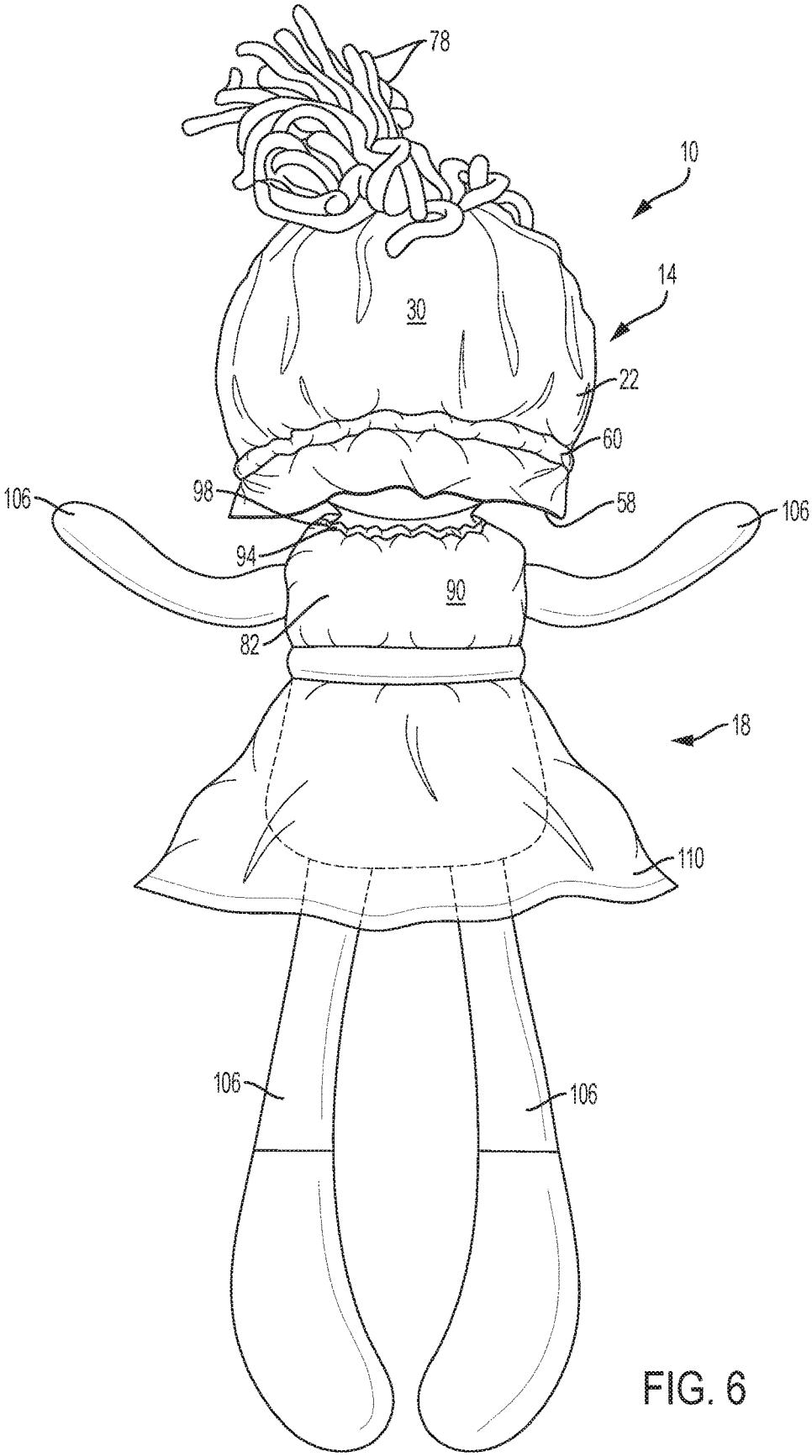
FIG. 6 is a rear view of the toy shown in the second state.
Figure 7:
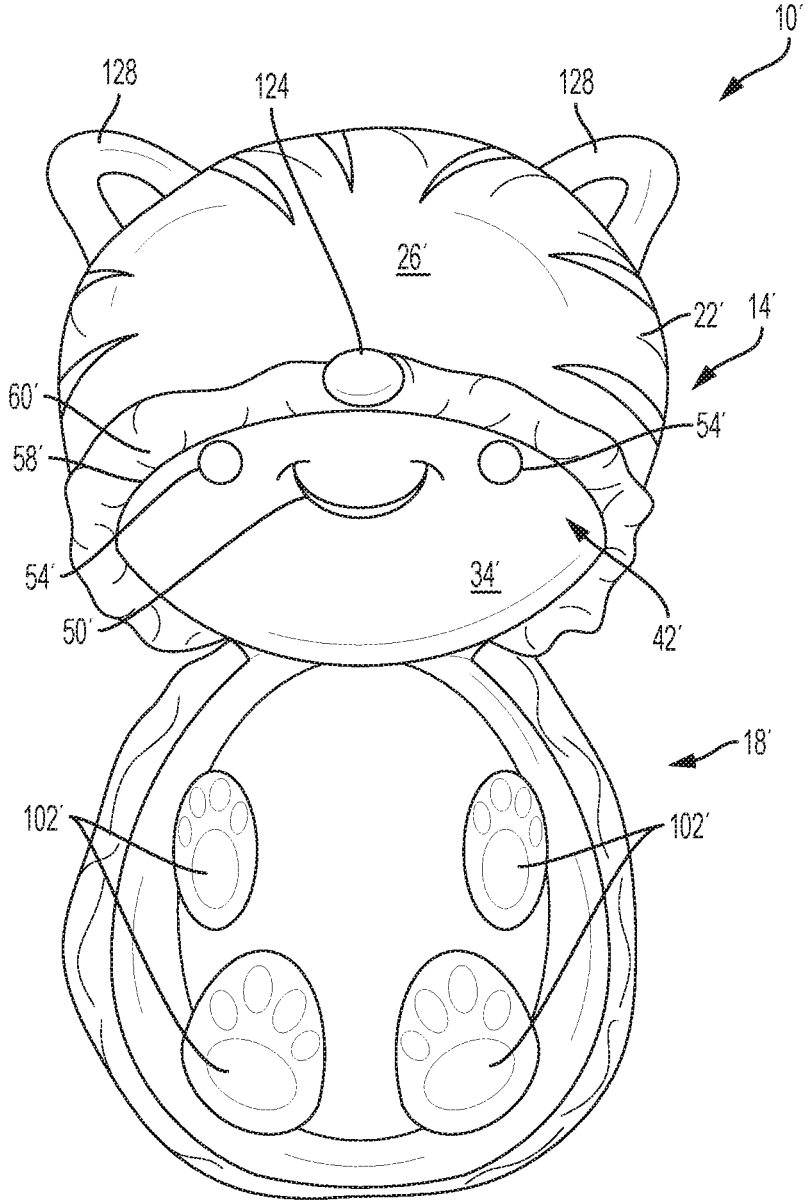
FIG. 7 is a front view of a toy according to a second embodiment of the invention shown in a first state representative of an infant animal.

FIG. 5 illustrates the transformation of the body 18 from the first configuration (see FIGS. 1 and 3) to the second configuration (see FIGS. 2 and 6). A second flap 82 coupled to the body 18 is moveable between at least two different positions to change which configuration of the body 18 is displayed. In the illustrated embodiment, the second flap 82 includes a first position that presents to view a first flap surface 86 (FIGS. 1 and 3) and a second position that presents to view a second flap surface 90 (FIG. 6). The first and second surfaces 86, 90 of the first flap 22 are opposite surfaces of the second flap 82, and as illustrated in FIGS. 1-6, form the interior and exterior surfaces of the flap 82, depending upon the position of the second flap 82 on the body 18.

The second flap 82 includes an edge 94. The edge 94 of the flap 82 can include an elastic member 98 to secure the flap 82 in position relative to the body 18. In the first position of the second flap 82 (FIGS. 1 and 3), the first surface 86 is exposed to view and includes sixth indicia 102 representing folds and seams of a blanket. The first position of the second flap 82 provides the first configuration of the body 18. In the illustrated first configuration of the body 18, the body appears to be wrapped or swaddled in a blanket much like an infant is wrapped or swaddled for sleeping. The illustrated body 18 has no projecting appendages in the first configuration. The edge 94 is held adjacent an upper front side of the body 18 (e.g., just beneath the head 14) by the elastic member 98.

In the second position of the second flap 82 (FIGS. 2 and 6), the second surface 90 is exposed to view on a rear side of the body 18, with the edge 94 held adjacent an upper rear side of the body 18 (e.g., just beneath the head 14) by the elastic member 98. The second position of the second flap 82 provides the second configuration of the body 18, representing a more mature child or young adult. More specifically, the body 18 in the second configuration includes projecting appendages 106 that represent two legs and two arms of the more mature child or young adult. In other embodiments, the projecting appendages could be any other appendages that might be associated with the bodies of animals or other creatures (e.g., tails, fins, wings, etc.). Additionally, the body 18 in the second configuration includes a skirt or dress 110. In the illustrated embodiment, each of the appendages 106 and the dress 110 are connected directly to the body 18 (e.g., sewn or otherwise secured). The elastic member 98 enables the second flap 82 to expand and define a pouch in which the appendages 106 and the dress 110 coupled to the body 18 are concealed from view when the body 18 is in the first configuration (i.e., when the flap 82 is in the first position). In the second configuration (i.e., when the flap 82 is in the second position), the appendages 106 and dress 110 are uncovered from within the pouch defined by the flap 82.

Transforming the toy 10 between the first body configuration and the second body configuration is achieved by moving the second flap 82 between the first and second positions. When the flap 82 is in the first position of FIG. 1 all of the appendages 106 and the dress 110 are hidden from view beneath the flap 82 and the first surface 86 is exposed to view revealing the sixth indicia 102 representing folds and seams of a blanket. In this first position, the flap 82 appears to be the swaddled blanket around the body of the infant. To transform the body 18 to the second configuration, in which the seemingly larger body of a more mature child or young adult is exposed to view, the flap 82 is moved (e.g., rotated or pivoted) about a seam $S_b$ (see FIG. 5) and underneath the bottom of the body 18 to the second position of FIGS. 2 and 6. The edge 94 of the flap 82 can be pulled all the way up to be positioned at the upper portion of the rear side of the body 18 adjacent the head 14. By this movement of the flap 82 to the second position, the appendages 106 and the dress 110 are uncovered by the flap 82 and exposed to view to represent legs, arms, and clothing coupled to the body 18.

To transform the toy 10 back to the first body configuration, the flap 82 is simply moved from the second position back under the bottom of the body 18 to the first position so that the appendages 106 and the dress 110 are covered by the flap 82. The edge 94 of the flap 82 can be carefully positioned at the top of the front side of the body 18 just beneath the head 14. In this manner, transforming the body 18 between the two configurations is easy.

With the toy 10 of the illustrated embodiment, moving the toy 10 from the first configuration to the second configuration is accomplished by moving both the first flap 22 on the head 14 and the second flap 82 on the body 18 in a direction from a front side of the toy 10 to a back side of the toy 10 when moving the flaps 22, 82 from the respective first positions to the respective second positions. With respect to FIGS. 4 and 5, this means that the first flap 22 moves in a clockwise direction when moving from the first position to the second position, while the second flap 82 moves in a counter-clockwise direction when moving from the first position to the second position. Likewise, the first flap 22 moves in a counter-clockwise direction when moving from the second position to the first position, while the second flap 82 moves in a clockwise direction when moving from the second position to the first position. However, in other embodiments, like in the second embodiment shown in FIGS. 7-12, the flap on the body may alternatively be moved in a direction from a back of the toy to a front of the toy when moving from the first position to the second position, while the flap on the head may still be moved in a direction from the front of the toy to the back of the toy when moving from the first position to the second position. Various other combinations and alternatives of flap movement directions may also be employed.

FIGS. 7-12 illustrate a second embodiment of a toy 10' that is similar to the toy 10 described above. Like parts have been given like reference numbers designated with the prime (') symbol. The toy 10' differs from the toy 10 in that instead of providing the transformable appearance between an infant human child and a more mature human child, it provides a transformable appearance between a young animal and a more mature animal (e.g., a kitten and a cat). As described above, the illustrated toys 10, 10' are only two examples. The invention can be practiced using virtually any creatures or characters desired. The first and second configurations of the head 14', and the method for achieving the transformation with the flap 22', are largely the same as described above with respect to the toy 10 and will not be described again here. One difference with the toy 10' is that the first surface 26' of the flap 22' has thereon a seventh indicia 124 (see FIG. 7) located adjacent the edge 58' that represents a nose of the first face 42' when the flap 22' is in the first position. The illustrated seventh indicia 124 is a separate feature coupled (e.g., sewn) to the edge 58' of the flap 22' and that projects outwardly from the first surface 26' to look like a projecting nose above the first indicia 50' representing the mouth. Additionally, the first flap 22' has appendages 128 representing ears coupled (e.g., sewn) to the first surface 26'. Of course, other embodiments may have different appendages 128 representing different features (e.g., hair, horns, fins, antennae, etc.).

The first and second configurations of the body 18', and the method for achieving the transformation with the flap 82', also have commonality with respect to the toy 10 that will not be described again here. However, there are some differences to be noted. First, since the toy 10' depicts an animal instead of a human, there are differences with the indicia and the appendages. The sixth indicia 102' on the front surface of the body 18' represents four paws of the cat. Furthermore, the appendages 106' on the body 18' that are exposed to view when the second flap 82' is in the second position (see FIGS. 8 and 12) represent four legs and a tail of the cat.

Figure 8:
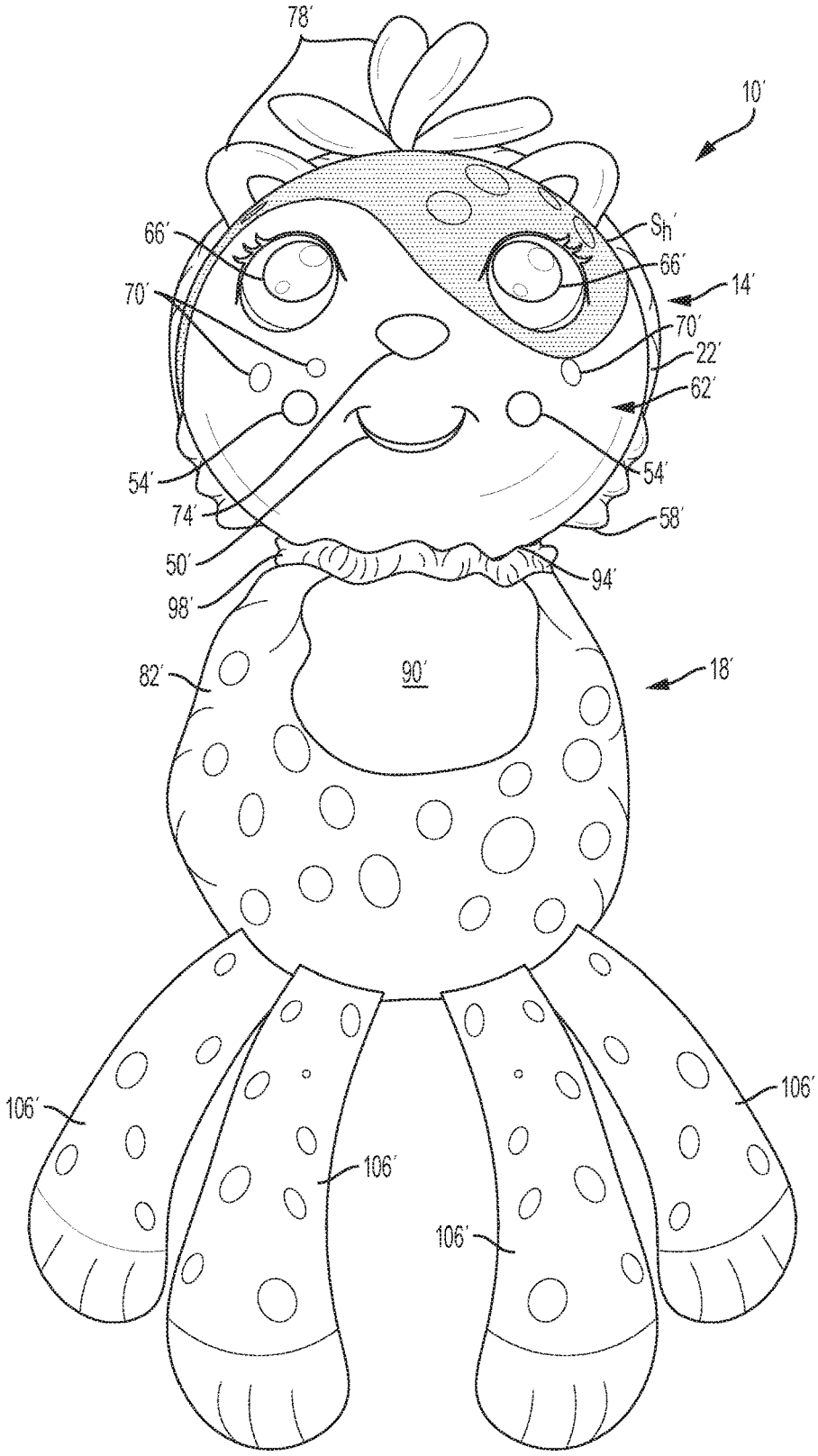
FIG. 8 is a front view of the toy of FIG. 7 shown in a second state representative of a more mature animal.
Figure 9:
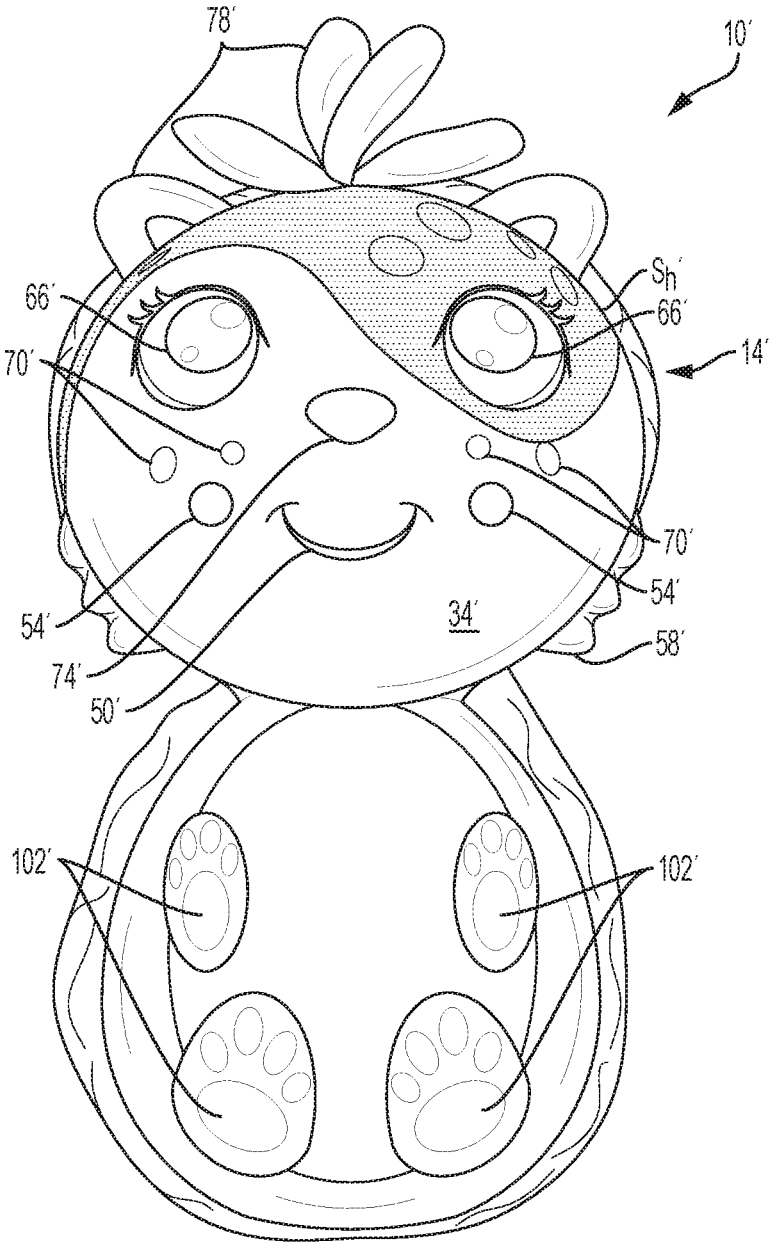
FIG. 9 is a front view of the toy of FIG. 7 showing the head transformed to a second configuration representing the more mature animal.
Figure 10:
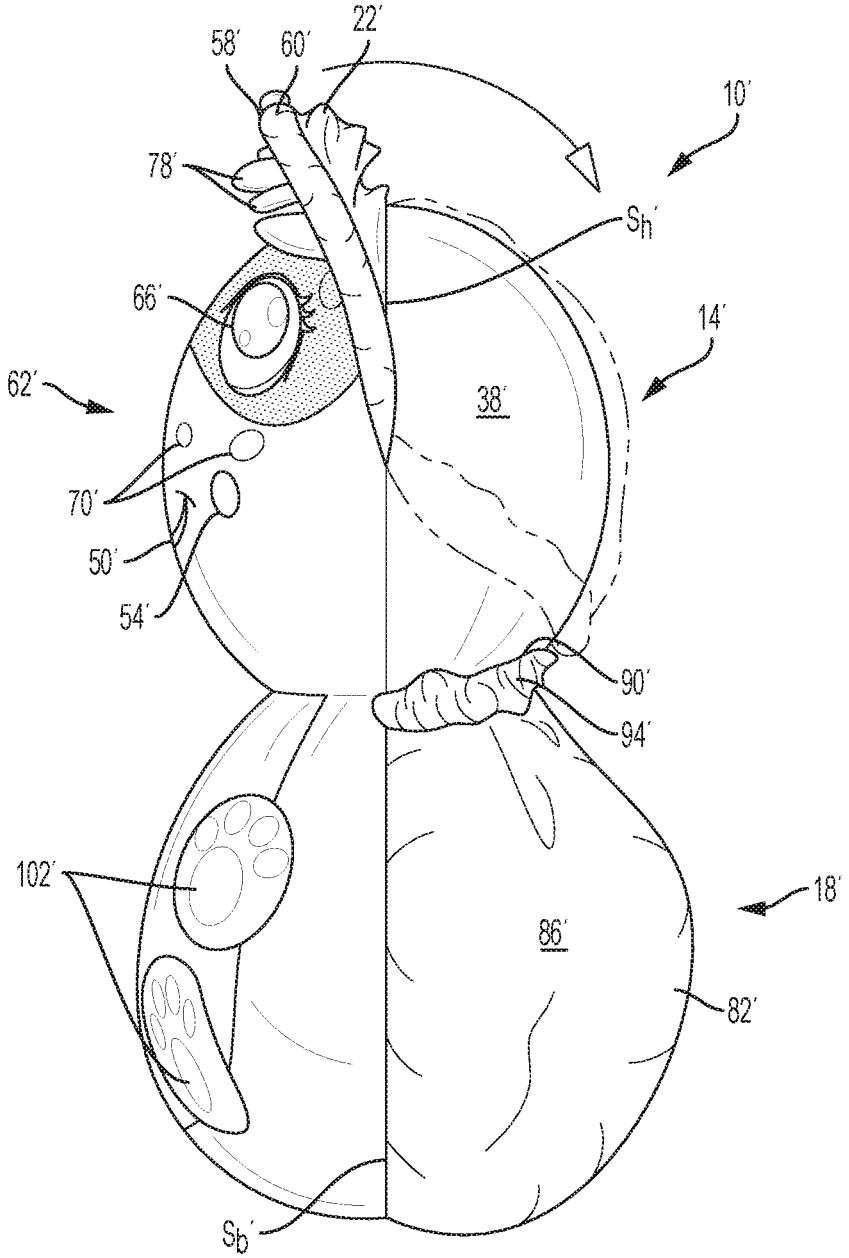
FIG. 10 is a side view of the toy of FIG. 7 showing the transformation of the head from a first head configuration to the second head configuration.
Figure 11:
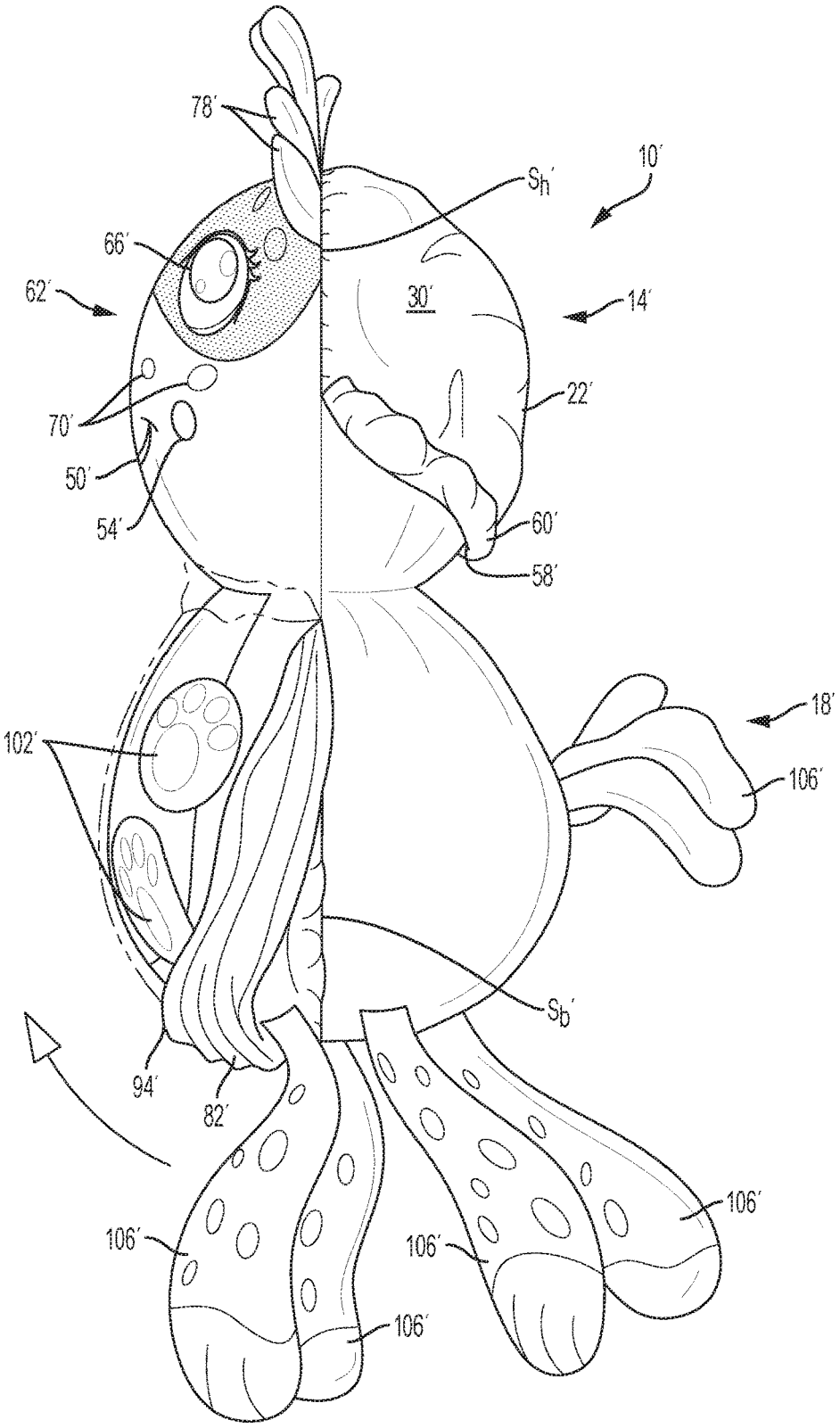
FIG. 11 is a side view of the toy of FIG. 7 showing the transformation of the body from a first body configuration to a second body configuration.
Figure 12:
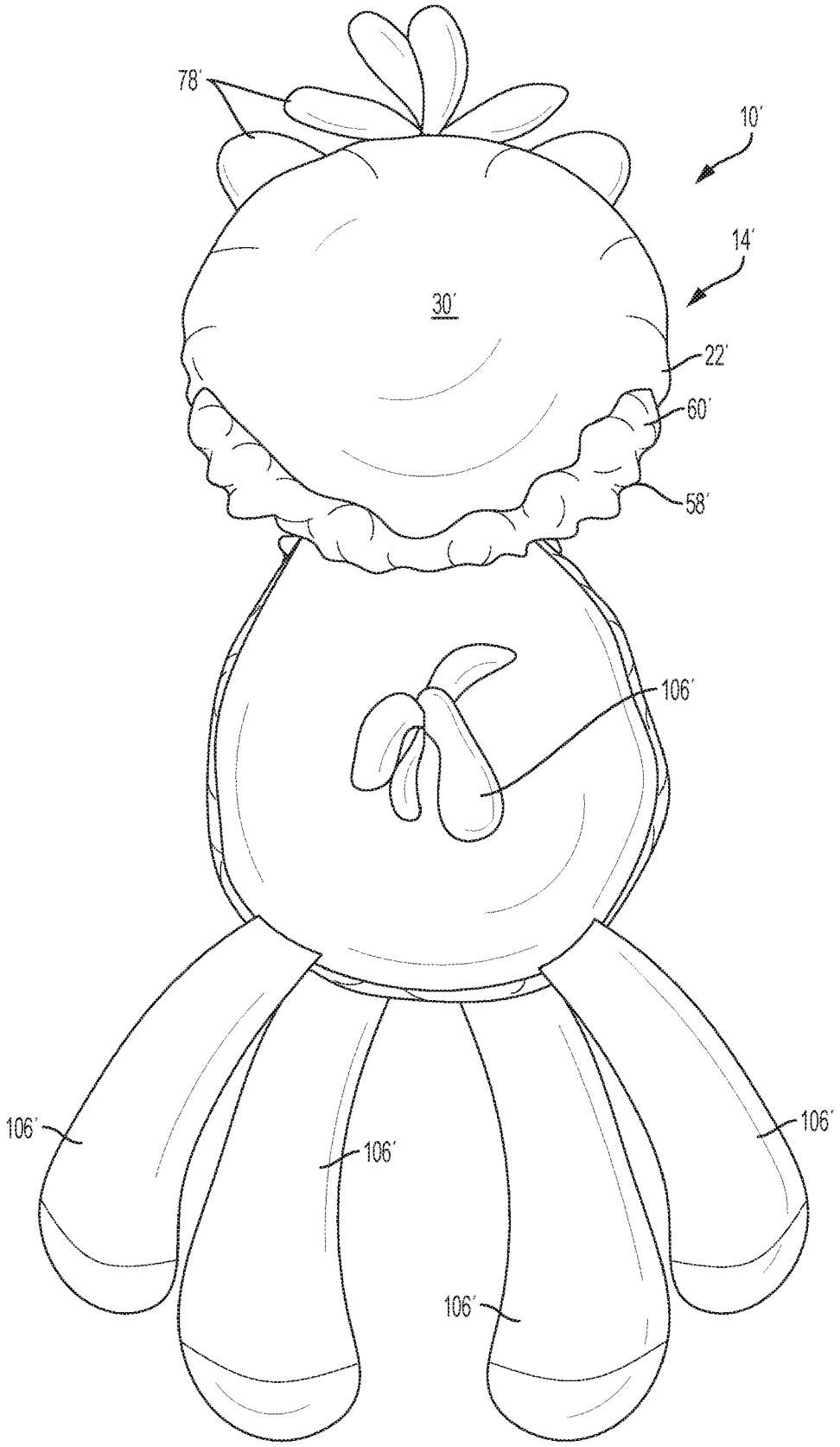
FIG. 12 is a rear view of the toy of FIG. 7 shown in the second state.

Another difference between the toy 10' and the toy 10 relates to positioning and direction of movement of the second flap 82' to achieve and transform between the first and second body configurations. Specifically, the second flap 82', when in the first position as shown in FIG. 10, has its edge 94' located adjacent an upper rear side of the body 18' (e.g., just beneath the head 14'). As such, the pouch defined by the second flap 82' and the body 18' stores the appendages 106' on a rear side of the body 18' when the flap is in the first position. To transform the body 18' to the second configuration as shown in FIG. 11, the edge 94' is pulled under the bottom of the body 18' about the seam $S_b'$ and toward the front side of the body 18'. As this occurs, the appendages 106' are released from within the pouch and exposed to view. The movement of the flap 82' continues until the edge 94' is located adjacent an upper front side of the body 18' (e.g., just beneath the head 14' as shown in FIG. 8). Therefore, unlike with the toy 10, the flap 82' on the body 18' of the toy 10' is moved in a direction from a back of the toy 10' to a front of the toy 10' when moving from the first position to the second position, while the flap 22' on the head 14' of the toy 10' is still moved in a direction from the front of the toy 10' to the back of the toy 10' when moving from the first position to the second position. With respect to FIGS. 10 and 11, this means that both flaps 22', 82' move in a clockwise direction when moving from the first position to the second position, and in a counter-clockwise direction when moving from the second position to the first position. However, in other embodiments, various other combinations and alternatives of flap movement directions may also be employed.

Various features and advantages of the invention are set forth in the following claims.

What is claimed is:

1. A toy comprising:

a body;

a head coupled to the body and having a face surface; and a flap coupled to the head for movement relative to the face surface between a first position in which a first face is exposed to view on the face surface, and a second position in which a second face, at least partially different from the first face, is exposed to view on the face surface;

wherein the first face includes a first indicia representing a first feature and a second indicia representing a second feature, and wherein the second face includes the first indicia representing the first feature, a third indicia distinct from the second indicia and representing a third feature, and the second indicia representing a fourth feature different from the second feature; and wherein when the flap is in the first position, the flap covers the third indicia but does not cover the first or the second indicia, and when the flap is in the second position, the flap does not cover the first, the second, or the third indicia.

2. The toy of claim 1, wherein when the flap is in the first position, a smaller area of the face surface is exposed to view to define the first face, and wherein when the flap is in the second position, a larger area of the face surface is exposed to view to define the second face.

3. The toy of claim 1, wherein on the first face the first indicia represents a mouth and the second indicia represents eyes, and wherein on the second face the first indicia represents the mouth, the third indicia represents eyes, and the second indicia represents freckles or dimples.

4. The toy of claim 3, wherein the second indicia representing eyes are smaller than the third indicia representing eyes, such that the eyes of the first face are smaller than the eyes of the second face.

5. The toy of claim 3, further comprising fourth indicia representing freckles on the second face and exposed to view when the flap is in the second position.

6. The toy of claim 3, wherein the flap represents a hat when in the first position.

7. The toy of claim 1, wherein the flap includes an elastic member provided therein to secure the flap in position relative to the face surface when the flap is in the first position.

8. The toy of claim 1, wherein the flap is coupled to the head about an upper perimeter of the face surface such that the flap can rotate relative to the head between the first and second positions.

9. The toy of claim 1, wherein the head further includes projecting members representing hair, the projecting members being hidden beneath the flap in the first position and exposed to view in the second position.

10. The toy of claim 1, further comprising a flap coupled to the body for movement relative to the body between a first position, in which the body is in a first configuration, and a second position, in which the body is in a second configuration.

11. The toy of claim 10, wherein the body has no projecting appendages in the first configuration, and wherein the body has projecting appendages representing arms, or legs, or both arms and legs in the second configuration.

12. The toy of claim 10, wherein the body further includes a dress or skirt when in the second configuration.

13. The toy of claim 10, wherein the flap coupled to the body includes an elastic member provided therein to secure the flap adjacent the body on oppositely facing sides of the body when in the first or second positions.

14. The toy of claim 13, wherein the elastic member enables the flap coupled to the body to expand and define a pouch in which appendages coupled to the body are concealed when the body is in the first configuration.

15. The toy of claim 10, wherein the flap on the body and the flap on the head are both moved in a direction from a first side of the toy to a second side of the toy when moving from the respective first positions to the respective second positions.

16. The toy of claim 10, wherein the flap on the body is moved in a direction from a second side of the toy to a first side of the toy when moving from the first position to the second position, and wherein the flap on the head is moved in a direction from the first side of the toy to the second side of the toy when moving from the first position to the second position.

17. The toy of claim 1, wherein the flap includes indicia representing a nose when the flap is in the first position.

18. A toy comprising:

a body;

a head coupled to the body, the head having a first configuration in which a first indicia representing a first feature and a second indicia representing a second feature are exposed to view on a face surface of the head, and a second configuration in which the first indicia representing the first feature, a third indicia representing a third feature, and the second indicia are all exposed to view on the face surface of the head, the second indicia representing a fourth feature different from the second feature when the head is in the second configuration; and a flap coupled to the head for movement relative to the face surface between a first position, in which the head is in the first configuration, and a second position, in which the head is in the second configuration;

wherein when the flap is in the first position, the flap covers the third indicia but does not cover the first or the second indicia, and wherein when the flap is in the second position, the flap does not cover the first, the second, or the third indicia; and wherein the face surface of the head has a larger exposed surface area in the second configuration than in the first configuration.

19. The toy of claim 18, wherein the flap represents a hat when the head is in the first configuration.

* * * * *